US006910013B2

(12) United States Patent
Allegro et al.

(10) Patent No.: US 6,910,013 B2
(45) Date of Patent: Jun. 21, 2005

(54) METHOD FOR IDENTIFYING A MOMENTARY ACOUSTIC SCENE, APPLICATION OF SAID METHOD, AND A HEARING DEVICE

(75) Inventors: Sylvia Allegro, Oetwil am See (CH); Michael Büchler, Zürich (CH)

(73) Assignee: Phonak AG, Stafa (CH)

( * ) Notice: Subject to any disclaimer, the term of this patent is extended or adjusted under 35 U.S.C. 154(b) by 247 days.

(21) Appl. No.: 09/755,412

(22) Filed: Jan. 5, 2001

(65) Prior Publication Data

US 2002/0037087 A1 Mar. 28, 2002

(51) Int. Cl.[7] ..... G10L 21/00; G10L 21/06

(52) U.S. Cl. ..... 704/256; 704/271; 704/255; 704/257; 704/200.1; 381/314; 381/312; 381/321; 381/83

(58) Field of Search ..... 704/255–257, 704/271, 200.1; 381/312, 314, 316, 321, 83, 93, 317, 318, 320

(56) References Cited

U.S. PATENT DOCUMENTS

| | | | | |
|---|---|---|---|---|
| 4,759,068 A | * | 7/1988 | Bahl et al. | 704/242 |
| 5,604,812 A | | 2/1997 | Meyer | |
| 5,848,384 A | * | 12/1998 | Hollier et al. | 704/231 |
| 6,002,116 A | | 12/1999 | St. Louis | |
| 6,009,396 A | * | 12/1999 | Nagata | 704/270 |
| 6,092,039 A | * | 7/2000 | Zingher | 704/221 |
| 6,240,192 B1 | * | 5/2001 | Brennan et al. | 381/314 |
| 6,480,610 B1 | * | 11/2002 | Fang et al. | 381/321 |

FOREIGN PATENT DOCUMENTS

| | | |
|---|---|---|
| EP | 0 732 036 B1 | 8/1994 |
| EP | 0 681 411 A | 11/1995 |
| EP | 0 814 636 A | 6/1996 |
| EP | 0 881 625 A | 12/1998 |
| WO | 0 1 76321 A | 10/2001 |

OTHER PUBLICATIONS

Mellinger, D.K. "Feature–ap methods for extracting sound frequency modulation" Signals, Systems and Computers, 1991. 1991 Conference Record of the Twenty–Fifth Asilomar Conference on Pacific Grove, CA, USA Nov. 4–6, 1991, Los Alamitos, CA, USA, IEEE Comput. Soc, US, pp. 795–799, XPO010026410.

(Continued)

*Primary Examiner*—Vijay B. Chawan
(74) *Attorney, Agent, or Firm*—Pearne & Gordon LLP

(57) ABSTRACT

The invention relates first of all to a method for identifying a transient acoustic scene, said method including the extraction, during an extraction phase, of characteristic features from an acoustic signal captured by at least one microphone (2*a*, 2*b*), and the identification, during an identification phase, of the transient acoustic scene on the basis of the extracted characteristics. According to the invention, at least auditory-based characteristics are identified in the extraction phase. Also specified are an application of the method per this invention and a hearing device.

21 Claims, 1 Drawing Sheet

OTHER PUBLICATIONS

Ostendorf, M. et al. "Klassifikation von akustischen Signalen basierend auf der Analyse von Modulationsspektren zur Anwendung in digitalen Hörgeräten." AG Medizinische Physik, Fachbereich Physik, Carl von Ossietzky Universität Oldenburg. Zeitschrift Für Audiologie–Supplementum Jan. 1998.

Kates, James M. "Classification of background noises for hearing–aid applications" Journal Acoustical Society of America, 97 (1), Jan. 1995.

Ostenforf, M. et al Empirische Klassifizierung verschiedener akustischer Signale und Sprache mittels einer Modulationsfrequenzanalyse. AG Medizinische Physik, Fachbereich Physik, Carl von Ossietzky Universität Oldenburg.

Edwards, Brent W. et al. "Signal–processing algorithms for a new software–based, digital haring device." The Hearing Journal, Sep. 1998, vol. 51, No. 9.

Hirsch, Herbert L. Statistical Signal Characterization, Published by Artech House, Inc., Norwood, MA., 1992.

Feldbusch, Friditjof. "Geräuscherkennung mittels Neuronaler Netze," Zeitschrift Für Audiologie Jan. 1998.

Claro AutoSelect, Phonak Hering Systems "Sound classification for an intelligent automatic multi–program management system.".

Yost, William A. "Fundamentals of Hearing An Introduction" 3rd ed., Academic Press, Inc., Copyright 1994, ISBN 0–12–772690–X.

Hartmann, William M. "Pitch, periodicity, and auditory organization." Journal Acoustical Society of America, vol. 100, No. 6, Dec. 1996.

Yost, William A. et al, "Auditory Perception" Human Psychophysics, 1993.

Mellinger, D. K. et al "Scene Analysis" Auditory Computation 1996.

Goldstein, Bruce E. "Wahrnehmunges–psychologie" Eine Einführung, 1997 Spektrum Akademischer Verlag GmbH Heidelberg.

Von Andreas K. Engel et al. "Neuronale Grundlagen der Gestaltwahrnehmung" Spektrum der Wissenschaft, Dossier, Kopf oder Computer.

Fundamentals of Hearing, Chapter 15, "Auditory Perception and Sound Source Determination", pp. 213–237, William A. Yost, 1977 by Academic Press, Inc.

Human Psychophysics, Chapter 6, "Auditory Perception", pp. 193–236, William A. Yost and Stanley Sheft, 1993.

Auditory Scene Analysis, Chapter 1, "The Auditory Scene", pp. 1–45, Albert S. Bregman, 1990.

* cited by examiner

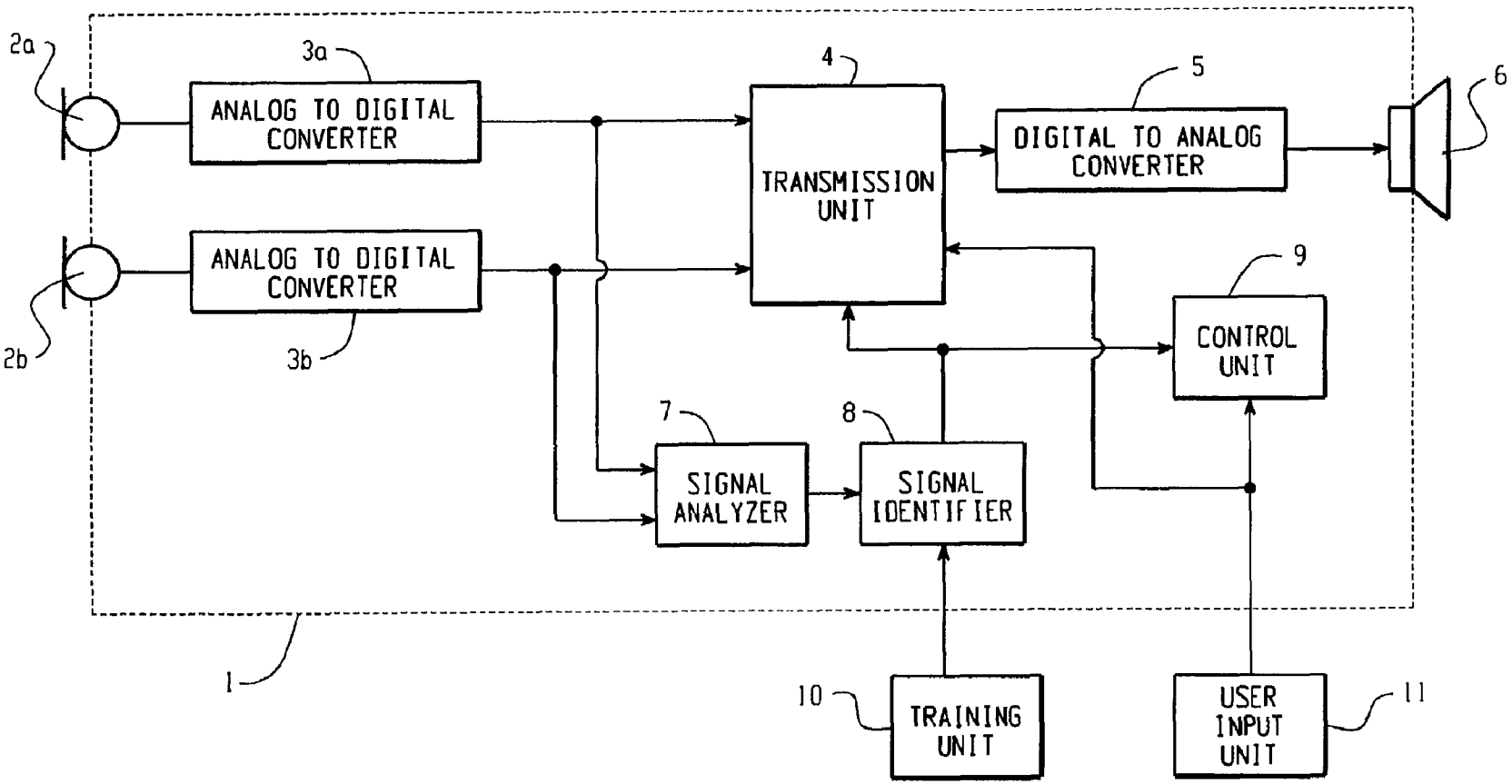
6
DIGITAL TO ANALOG CONVERTER
5
TRANSMISSION UNIT
4
ANALOG TO DIGITAL CONVERTER
3a
ANALOG TO DIGITAL CONVERTER
3b
2a
2b
CONTROL UNIT
9
SIGNAL IDENTIFIER
8
SIGNAL ANALYZER
7
USER INPUT UNIT
11
TRAINING UNIT
10
1

METHOD FOR IDENTIFYING A MOMENTARY ACOUSTIC SCENE, APPLICATION OF SAID METHOD, AND A HEARING DEVICE

BACKGROUND OF THE INVENTION

This invention relates to a method for identifying a momentary acoustic scene, an application of said method in conjunction with hearing well as a hearing device.

Modern-day hearing aids, when employing different audiophonic programs—typically two to a maximum of three such hearing programs—permit their adaptation to varying acoustic environments or scenes. The idea is to optimize the effectiveness of the hearing aid for its user in all situations.

The hearing program can be selected either via a remote control or by means of a selector switch on the hearing aid itself. For many users, however, having to switch program settings is a nuisance, or difficult, or even impossible. Nor is it always easy even for experienced wearers of hearing aids to determine at what point in time which program is most comfortable and offers optimal speech discrimination. An automatic recognition of the acoustic scene and corresponding automatic switching of the program setting in the hearing aid is therefore desirable.

There exist several different approaches to the automatic classification of acoustic surroundings. All of the methods concerned involve the extraction of different characteristics from the input signal which may be derived from one or several microphones in the hearing aid. Based on these characteristics, a pattern-recognition device employing a particular algorithm makes a determination as to the attribution of the analyzed signal to a specific acoustic environment. These various existing methods differ from one another both in terms of the characteristics on the basis of which they define the acoustic scene (signal analysis) and with regard to the pattern-recognition device which serves to classify these characteristics (signal identification).

For the extraction of characteristics in audio signals, J. M. Kates in his article titled "Classification of Background Noises for Hearing-Aid Applications" (1995, Journal of the Acoustical Society of America 97(1), pp 461–469), suggested an analysis of time-related sound-level fluctuations and of the sound spectrum. On its part, the European patent EP-B1-0 732 036 proposed an analysis of the amplitude histogram for obtaining the same result. Finally, the extraction of characteristics has been investigated an implemented based on an analysis of different modulation frequencies. In this connection, reference is made to the two papers by Ostendorf et al titled "Empirical Classification of Different Acoustic Signals and of Speech by Means of a Modulation-Frequency Analysis" (1997, DAGA 97, pp 608–609), and "Classification of Acoustic Signals Based on the Analysis of Modulation Spectra for Application in Digital Hearing Aids" (1998), DAGA 98, pp 402–403). A similar approach is described in an article by Edwards et al titled "Signal-processing algorithms for a new software-based, digital hearing device" (1998, The Hearing Journal 51, pp 44–52). Other possible characteristics include the sound-level transmission itself or the zero-passage rate as described for instance in the book by H. L. Hirsch, titled "Statistical Signal Characterization" (Artech House 1992). It is evident that the characteristics used to date for the analysis of audio signals are strictly based on system-specific parameters.

It is fundamentally possible to use prior-art pattern identification methods for sound classification purposes. Particularly suitable pattern-recognition systems are the so-called distance classifiers, Bayes classifiers, fuzzy-logic systems and neural networks. Details for the first two of the methods mentioned are contained in the publication titled "Pattern Classification and Scene Analysis" by Richard O. Duda and Peter E. Hart (John Wiley & Sons, 1973). For information on neural networks, reference is made to the treatise by Christopher M. Bishop, titled "Neural Networks for Pattern Recognition" (1995, Oxford University Press). Reference is also made to the following publications: Ostendorf et al, "Classification of Acoustic Signals Based on the Analysis of Modulation Spectra for Application in Digital Hearing Aids" (Zeitschrift fir Augdiologie (Journal of Audiology), pp 148–150); F. Feldbusch, "Sound Recognition Using Neural Networks" (1998, Journal of Audiology, pp 30–36); European patent application, publication number EP-A1-0 814 636; and US patent, publication number U.S. Pat. No. 5,604,812. Yet all of the pattern-recognition methods mentioned are deficient in one respect in that they merely model static properties of the sound categories of interest.

One shortcoming of these earlier sound-classification methods, involving characteristics extraction and pattern recognition, lies in the fact that, although unambiguous and solid identification of voice signals is basically possible, a number of different acoustic situations cannot be satisfactorily classified, or not at all. While these earlier methods permit a distinction between pure voice or speech signals and "non-speech" sounds, meaning all other acoustic surroundings, that is not enough for selecting an optimal hearing program for a momentary acoustic situation. It follows that the number of possible hearing programs is limited to those two automatically recognizable acoustic situations or the hearing-aid wearer himself has to recognize the acoustic situations that are not covered and manually select the appropriate hearing program.

SUMMARY OF THE INVENTION

It is therefore the objective of this invention to introduce first of all a method for identifying a momentary acoustic scene which compared to prior-art methods is substantially more reliable and more precise.

This is accomplished by the measures specified in claim 1. Additional claims specify advantageous enhancements of the invention, an application of the method, as well as a hearing device.

The invention is based on an extraction of signal characteristics, a subsequent separation of different sound-sources as well as an identification of different sounds. In lieu of or in addition to system-specific characteristics, auditory characteristics are taken into account in the signal analysis for the extraction of characteristic features. These auditory characteristics are identified by means of Auditory Scene Analysis (ASA) techniques. In another form of implementation of the method per this invention, the characteristics are subjected to a context-free or a context-sensitive grouping process by applying the Gestalt principles. The actual identification and classification of the audio signals derived from the extracted characteristics is preferably performed using Hidden Markov Models (HMM). One advantage of this invention is the fact that it allows for a large number of identifiable sound categories and thus a greater number of hearing programs which results in enhanced sound classification and correspondingly greater comfort for the user of the hearing device.

The following will explain this invention in more detail by way of an example with reference to a drawing. The only FIGURE is a functional block diagram of a hearing device in which the method per this invention has been implemented.

BRIEF DESCRIPTION OF THE DRAWINGS

In the FIGURE, the reference number 1 designates a hearing device. For the purpose of the following description, the term "hearing device" is intended to include hearing aids as used to compensate for the hearing impairment of a person, but also all other acoustic communication systems such as radio transceivers and the like.

DETAILED DESCRIPTION OF THE INVENTION

The hearing device 1 incorporates in conventional fashion two electro-acoustic converters 2*a*, 2*b* and 6, these being one of several microphone 2*a*, 2*b* and a speaker 6, also referred to as a receiver. A main component of a hearing device 1 is a transmission unit 4 in which, in the case of a hearing aid, signal modification takes place in adaptation to the requirements of the user of the hearing device 1. However, the operations performed in the transmission unit 4 are not only a function of the nature of a specific purpose of the hearing device 1 but are also, and especially, a function of the momentary acoustic scene. There have already been hearing aids on the market where the wearer can manually switch between different hearing programs tailored to specific acoustic situations. There also exist hearing aids capable of automatically recognizing the acoustic environment. In that connection, reference is again made to the European patens EP-B1-0 732 036 and EP-A1 814 636 and to the U.S. Pat. No. 5,604,812, as well as to the "Claro Autoselect" brochure by Phonak Hearing Systems (28148 (GB) /0300, 1999).

In addition to the aforementioned components such as microphones 2*a*, 2*b*, the transmission unit 4 and the receiver 6, the hearing device 1 contains a signal analyzer 7 and a signal identifier 8. If the hearing device 1 is based on digital technology, one or several analog-to-digital converters 3*a*, 3*b* are interpolated between the microphones 2*a*, 2*b* and the transmission unit 4 and one digital-to-analog converter 5 is provided between the transmission unit 4 and the receiver 6. While a digital implementation of this invention is preferred, it should be equally possible to use analog components throughout. In that case, of course, the converters 3*a*, 3*b* and 5 are not needed.

The signal analyzer 7 receives the same input signal as the transmission unit 4. The signal identifier 8, which is connected to the output of the signal analyzer 7, connects at the other end to the transmission unit 4 and to a control unit 9.

A training unit 10 serves to establish in off-line operation the parameters required in the signal identifier 8 for the classification process.

By means of a user input unit 11, the user can override the settings of the transmission unit 4 and the control unit 9 as established by the signal analyzer 7 and the signal identifier 8.

The method according to this invention is explained as follows:

It is essentially based on the extraction of characteristic features from an acoustic signal during an extraction phase, whereby, in lieu of or in addition to the system-specific characteristics such as the above-mentioned zero-passage rates, time-related sound-level fluctuations, different modulation frequencies, the sound level itself, the spectral peak, the amplitude distribution etc. auditory characteristics as well are employed. These auditory characteristics are determined by means of an Auditory Scene Analysis (ASA) and include in particular the loudness, the spectral pattern (timbre), the harmonic structure (pitch), common build-up and decay times (on-/offsets), coherent amplitude modulations, coherent frequency modulations, coherent frequency transitions, binaural effects etc. Detailed descriptions of Auditory Scene Analysis can be found for instance in the articles by A. Bregman, "Auditory Scene Analysis" (MIT Press, 1990) and W. A. Yost, "Fundamentals of Hearing—An Introduction" (Academic Press, 1977). The individual auditory characteristics are described, inter alia, by A. Yost and S. Sheft in "Auditory Perception" (published in "Human Psychophysics" by W. A. Yost, A. N. Popper and R. R. Fay, Springer 1993), by W. M. Hartmann in "Pitch, Periodicity and Auditory Organization" (Journal of the Acoustical society of America, 100 (6), pp 3491–3502, 1996), and by D. K. Mellinger and B. M. Mont-Reynaud in "Scene Analysis" (published in "Auditory Computation" by H. L. Hawkins, T. A. McMullen, A. N. Popper and R. R. Fay, Springer 1996).

In this context, an example of the use of auditory characteristics in signal analysis is the characterization of the tonality of the acoustic signal by analyzing the harmonic structure, which is particularly useful in the identification of tonal signals such as speech and music.

Another form of implementation of the method according to this invention additionally provides for a grouping of the characteristics in the signal analyzer 7 by means of Gestalt analysis. This process applies the principle3s of the Gestalt theory, by which such qualitative properties as continuity, proximity, similarity, common destiny, unity, good constancy and others are examined, to the auditory and perhaps system-specific characteristics for the creation of auditory objects. This grouping—and, for that matter, the extraction of characteristics in the extraction phase—can take place in context-free fashion, i.e. without any enhancement by additional knowledge (so-called "primitive" grouping), or in context-sensitive fashion in the sense of human auditory perception employing additional information or hypotheses regarding the signal content (so-called schema-based" grouping). This means that the contextual grouping is adapted to any given acoustic situation. For a detailed explanation of the principles of the Gestalt theory and of the grouping process employing Gestalt analysis, substitutional reference is made to the publications titled "Perception Psychology" by E. B. Goldstein (Spektrum Akademiseher Verlag, 1997), "Neural Fundamentals of Gestalt Perception" by A. K. Engel and W. Singer (Spektrum der Wissenschaft, 1998, pp 66–73), and "Auditory Scene Analysis" by A. Bregman (MIT Press, 1990).

The advantage of applying this grouping process lies in the fact that it allows further differentiation of the characteristics of the input signals. In particular, signal segments are identifiable which originate in different sound-sources. The extracted characteristics can thus be mapped to specific individual sound sources, providing additional information on these sources and, hence, on the current auditory scene.

The second aspect of the method according to this invention as described here relates to pattern recognition, i.e. the signal identification that takes place during the identification phase. The preferred form of implementation of the method per this invention employs the Hidden Markov Model (HMM) method in the signal identifier 8 for the automatic classification of the acoustic scene. This also permits the use of time changes of the computed characteristics for the classification process. Accordingly, it is possible to also take into account dynamic and not only static properties of the surrounding situation and of the sound categories. Equally possible is a combination of HMMs with other classifiers such as multi-stage recognition processes for identifying the acoustic scene.

The output signal of the signal identifier 8 thus contains information on the nature of the acoustic surroundings (the acoustic situation or scene). That information is fed to the transmission unit 4 which selects the program, or set of parameters, best suited to the transmission of the acoustic scene discerned. At the same time, the information gathered in the signal identifier 8 is fed to the control unit 9 for further actions whereby, depending on the situation, any given function, such as an acoustic signal, can be triggered.

If the identification phase involves Hidden Markov Models, it will require a complex process for establishing the parameters needed for the classification. This parameter ascertainment is therefore best done in the off-line mode, individually for each category or class at a time. The actual identification of various acoustic scenes requires very little memory space and computational capacity. It is therefore recommended that a training unit 10 be provided which has enough computing power for parameter determination and which can be connected via appropriate means to the hearing device 1 for data transfer purposes. The connecting means mentioned may be simple wires with suitable plugs.

The method according to this invention thus makes it possible to select from among numerous available settings and automatically pollable actions the one best suited without the need for the user of the device to make the selection. This makes the device significantly more comfortable for the user since upon the recognition of a new acoustic scene it promptly and automatically selects the right program or function in the hearing device 1.

The users of hearing devices often want to switch off the automatic recognition of the acoustic scene and corresponding automatic program selection, described above. For this purpose a user input unit 11 is provided by means of which it is possible to override the automatic response or program selection. The user input unit 11 may be in the form of a switch on the hearing device 1 or a remote control which the user can operate. There are also other options which offer themselves, for instance a voice-activated user input device.

What is claimed is:

1. A method for identifying a momentary acoustic scene, said method including an extraction, during an extraction phase, of characteristics from an acoustic signal captured by at least one microphone (2*a*, 2*b*), wherein at least auditory characteristics are extracted and an identification, during an identification phase, of the momentary acoustic scene on the basis of the extracted characteristics by mapping the extracted characteristics to specific individual sound sources of a plurality of different sound sources and selecting and executing a process for analyzing and modifying an acoustic signal, said process taken from a plurality of available processes based on the identified momentary acoustic scene.

2. Method as in claim 1, wherein, for the identification of the characteristic features during the extraction phase, Auditory Scene Analysis (ASA) techniques are employed.

3. Method as in claim 1, wherein, during the identification phase, Hidden Markov Model (HMM) techniques are employed for the identification of the momentary acoustic scene.

4. Method as in claim 1, wherein at least one of the following auditory characteristics are identified during the extraction of said characteristic features: loudness, spectral pattern, harmonic structure, common build-up and decay processes, coherent amplitude modulations, coherent frequency modulations, coherent frequency transitions and binaural effects.

5. Method as in claim 1, wherein at least one non-auditory characteristic is identified in addition to the auditory characteristics.

6. Method as claim 1, wherein the auditory characteristics are grouped along Gestalt theory principles.

7. Method as in claim 6, wherein the extraction of characteristics and/or the grouping of the characteristics are performed either in context-free or in context-sensitive fashion, and further including the step of taking into account information relative to a signal content to thereby provide an adaptation to the acoustic scene.

8. Method as in claim 1, wherein, during the identification phase, data are accessed which were acquired in an off-line training phase.

9. A method for identifying and selecting an appropriate process for analyzing an acoustic signal, said method including an extraction, during an extraction phase, of characteristics from said acoustic signal, wherein at least auditory characteristics are extracted ;

an identification, during an identification phase, of a momentary acoustic scene on the basis of the extracted characteristics by mapping the extracted characteristics to specific individual sound sources of a plurality of different sound sources;

selecting a process for analyzing the acoustic signal based on the identified momentary acoustic scene, wherein said suitable process is chosen from a plurality of available processes for analyzing the acoustic signal; and executing said selected process to generate and output a processed acoustic signal.

10. The process of claim 9, wherein said extraction includes the step of analyzing the acoustic structure of the acoustic signal for identifying tonal signals in acoustical signals generated by speech and tonal signals generated by music.

11. The process of claim 9, wherein said extraction applies the principles of gestalt analysis for acoustical signals generated by speech and tonal signals generated by music.

12. The process of claim 11, wherein said gestalt analysis includes examining a qualitative property chosen from the group consisting of continuity, proximity, similarity, common density, unit, and good constancy.

13. The process of claim 9, wherein said executing said selected suitable process includes the step of processing said acoustic signal to generate a hearing signal for improving the hearing ability of a user.

14. The process of claim 9, further including the step of generating an audio signal from said processed acoustic signal for transmission to a user.

15. A method for identifying and selecting an appropriate process for analyzing an acoustic signal, said method including an extraction, during an extraction phase, of characteristics from said acoustic signal including the step of analyzing the acoustic structure of the acoustic signal for identifying tonal signals in acoustical signals generated by speech and tonal signals generated by music, wherein at least auditory characteristics are extracted ; and an identification, during an identification phase, of a momentary acoustic scene on the basis of the extracted characteristics by mapping the extracted characteristics to each of a plurality of specific individual sound sources, and further wherein said identification includes the use of hidden markov models; and selecting a process for analyzing the acoustic signal based on the identified momentary acoustic scene, wherein said suitable process is chosen from a plurality of available processes, said process for improving the hearing ability of a user;

executing said selected process, said executing including the step of processing said acoustic signal to generate a processed audio signal; and generating an audio signal from said processed acoustic signal for transmission to said user.

16. A method for identifying and selecting an appropriate process for analyzing an acoustic signal, said method including:

an extraction of at least auditory-based characteristic features from an acoustic signal, wherein said auditory characteristics include one or more of: volume, spectral pattern, harmonic structure, common build-up and decay times, coherent amplitude modulations, coherent frequency modulations, coherent frequency transitions, and binaural effects; and an identification of the momentary acoustic scene on the basis of the characteristics not limited to speech characteristics; and automatically selecting a hearing process for execution by a hearing device from a plurality of available processes based on the identified momentary acoustic scene.

17. The method of claim 16, wherein said identification includes at least a determination of whether the momentary acoustic scene includes speech, music, or some other auditory activity.

18. The method of claim 16, further comprising a step of grouping the characteristic features according to: continuity, proximity, similarity, common density, unit, and good constancy; wherein said grouping supports the identification of the momentary acoustic scene.

19. A method for identifying a momentary acoustic scene for a hearing device, said method including an extraction, during an extraction phase, of characteristics from an acoustic signal captured by at least one microphone, wherein at least auditory characteristics are extracted and an identification, during an identification phase, of the momentary acoustic scene on the basis of the extracted characteristics; and selecting and executing an audio signal analyzing process from a plurality of available audio signal analyzing processes based on the identified momentary acoustic scene, said audio signal analyzing process for execution in a hearing device for improving the hearing of a user.

20. The method of claim 19, further comprising a step of grouping the characteristic features according to: continuity, proximity, similarity, common density, unit, and good constancy; wherein said grouping supports the identification of the momentary acoustic scene.

21. The process of claim 19, wherein said execution generates a processed acoustic signal, said process further including the step of said hearing device generating an audio signal from said processed acoustic signal for transmission to a user to aid the hearing of the user.

* * * * *

UNITED STATES PATENT AND TRADEMARK OFFICE

CERTIFICATE OF CORRECTION

PATENT NO. : 6,910,013 B2
APPLICATION NO. : 09/755412
DATED : June 21, 2005
INVENTOR(S) : Silvia Allegro and Michael Büchler It is certified that error appears in the above-identified patent and that said Letters Patent is hereby corrected as shown below:

On the Title page, item (75), please delete “Sylvia” and insert --Silvia--

On the Title page, item (56), References Cited, Other Publications, Mellinger, D.K., line 5, after “US,”, please insert --4 November 1991--

Title Page;
On page 2, Other Publications, Edwards, Brent W., line 2, please delete “haring” and insert --hearing--

Title Page;
On page 2, Other Publications, Claro AutoSelect, line 1, please delete “Hering” and insert --Hearing--

In column 1, line 10, after “hearing” and before “well”, please insert --devices, as--

In column 2, line 13, please delete “fir Augdiologie” and insert --für Audiologic--

In column 2, line 17, please delete “U.S. Pat. No.”

In column 3, line 31, please delete “patens” and insert --patents--

In column 4, line 17, please delete “society” and insert --Society--

In column 4, line 30, please delete “principle3s” and insert --principles--

In column 4, line 41, please delete “schema-based”” and insert --“schema-based”--

In column 6, line 26, please delete “extracted ;” and insert --extracted;--

UNITED STATES PATENT AND TRADEMARK OFFICE

CERTIFICATE OF CORRECTION

PATENT NO. : 6,910,013 B2
APPLICATION NO. : 09/755412
DATED : June 21, 2005
INVENTOR(S) : Silvia Allegro and Michael Büchler It is certified that error appears in the above-identified patent and that said Letters Patent is hereby corrected as shown below:

In column 6, line 66, please delete “extracted ;” and insert --extracted;--

Signed and Sealed this

Twentieth Day of November, 2007

JON W. DUDAS
*Director of the United States Patent and Trademark Office*